United States Patent [19]

Pfannkuche

[11] 4,230,192

[45] Oct. 28, 1980

[54] CORE SAMPLING APPARATUS AND METHOD

[76] Inventor: Fritz T. Pfannkuche, 2205 Dunstan, Houston, Tex. 77005

[21] Appl. No.: 932,027

[22] Filed: Aug. 8, 1978

[51] Int. Cl.[2] ..... E21B 9/20

[52] U.S. Cl. ..... 175/59; 175/233; 175/237; 175/239; 175/242

[58] Field of Search ..... 175/233, 226, 236, 237, 175/239, 240, 241, 245, 251, 252, 59, 58, 254

[56] References Cited

U.S. PATENT DOCUMENTS

| | | | |
|---|---|---|---|
| 2,347,726 | 5/1944 | Auld et al. | 175/236 X |
| 2,734,719 | 2/1956 | Otway | 175/233 |
| 3,146,837 | 9/1964 | Bridwell | 175/59 |
| 3,548,958 | 12/1970 | Blackwell | 175/233 |
| 4,142,594 | 3/1979 | Thompson | 175/233 |

*Primary Examiner*—William F. Pate, III
*Attorney, Agent, or Firm*—Bill B. Berryhill

[57] ABSTRACT

Coring apparatus for obtaining core samples which may comprise: an outer barrel assembly, the lower end of which is adapted for connection to a core bit, the upper end of which is adapted for connection to a drill string; an inner barrel assembly concentrically disposed within the outer barrel assembly and having first and second axially spaced and fluid communicating chambers therein; and valve means carried by the inner barrel assembly and movable from an open position, in which a core sample may be received by the first chamber, to a closed position, sealingly enclosing the core sample within the first chamber. A method of obtaining core samples with the coring apparatus may comprise the steps of: lowering the coring apparatus and a core bit into a well bore on a drill string; rotating the drill string so the core bit cuts away an annular area at the bottom of the well bore, leaving a substantially cylindrical core extending upwardly into the inner barrel assembly; breaking the core near the base thereof to provide a core sample of desired length; continuing to rotate the drill string until the broken core sample is totally within the first chamber; lifting the drill string to clear core remaining in the well bore; actuating the valve assembly to sealingly enclose the core sample within the inner barrel assembly; and raising the coring apparatus to the surface of the well while allowing at least some of the fluid contained in the core sample to expand into the second chamber.

25 Claims, 10 Drawing Figures

CORE SAMPLING APPARATUS AND METHOD

BACKGROUND OF THE INVENTION

1. Field of the Invention

The present invention pertains to apparatus and methods for obtaining core samples from subterranean formations. More specifically, it pertains to apparatus and methods for obtaining core samples from the bottom of a well bore, primarily in producing and exploring for oil and gas or other minerals. In particular, the present invention is directed to apparatus and methods for obtaining pressurized core samples and raising them to the surface of the well without losing liquids and gases contained therein and without creating an overpressured and potentially dangerous core barrel.

2. Brief Description of the Prior Art

It has long been a practice in drilling of oil and gas wells to monitor or examine the subterranean formations in which the well is being drilled by obtaining a core sample at the bottom of the well bore. Customarily, a core is obtained by drilling an annulus at the bottom of the well bore, leaving a cylindrical core section extending upwardly within a core barrel of some type. The core section or sample is then broken off and retrieved to the surface for examination and analysis. In the past, such coring was done by cable tool devices or by removing the drill string with the core sample captured therein. The core sample is of course initially at the bottom of the well where it may be under very high formation pressures. In core devices of the prior art, the natural pressure within the core is reduced as the core is brought to the surface until it is essentially at atmospheric pressure. As this pressure is reduced, it is probable that much of the liquids and gas, which are naturally captured in the core, will be released so that once the core reaches the surface, it is difficult to determine what may have been contained in the strata at the bottom of the hole.

Because of the problems associated with losing formation pressure, core barrel devices have been developed which capture the core at the bottom of the well, then seal it within a pressurized barrel for removal to the surface. One such cable device is shown in U.S. Pat. No. 2,347,726. Other pressure capturing core barrel devices for attachment to the lower end of a drill string are shown in U.S. Pat. Nos. 3,064,742; 3,146,837; and 3,454,117. However, since the pressure at the bottom of a well hole may be extremely high, e.g. 10,000 p.s.i., the core in such an assembly may be encapsulated in a cylinder which is potentially a bomb when it reaches the surface. It may be hazardous to disassemble and requires extremely careful handling at the surface with specialized equipment.

In recent years, one or two core sampling devices have been developed which totally capture a pressurized sample, but allows for some reduction of pressure within the core barrel as it is raised to the surface so that when the core sample reaches the surface, it is at a much more practical pressure for working with, yet retains the liquids and gases present in the sampled strata. One such device is disclosed in U.S. Pat. No. 2,287,909 (Sewell). In Sewell, a rubber sleeve, silfon bellows, rubber baloon or other type of expansion member is provided in fluid communication with the chamber in which the core sample is received. However, the type of expansion members disclosed in Sewell are of relatively small volume and are not suitable for the high pressure formations encountered in modern drilling practice. It is not uncommon to encounter formations in which gas or vapors therein will expand several hundred times at atmospheric pressure. The coring device of Sewell could not accommodate such expansion and would probably fail well before reaching the surface.

While othbrs may have attempted to develop coring apparatus suitable for capturing high pressure core samples for sealed retrieval to the surface, while allowing the pressure within the device to be reduced as it is brought to the surface of the well. Since such sampling apparatus and methods are highly desired for proper sampling and analysis, the search will undoubtedly continue to overcome the disadvantages of coring apparatus and methods of the prior art.

SUMMARY OF THE INVENTION

In the coring apparatus of the present invention, an outer barrel assembly is provided, the lower end of which is adapted for connection to a core bit and the upper end of which is adapted for connection to a drill string. An inner barrel assembly is concentrically disposed within the outer barrel assembly and provided with first and second axially spaced and fluid communication chambers therein. At least one valve assembly is carried by the inner barrel assembly for movement from an open position, in which a core sample may be received within the first chamber, to a closed position, sealingly enclosing the core sample within the first chamber. A pressure balancing plug or piston member is sealingly disposed within the second chamber, allowing expansion of the second chamber for receiving expanding fluids from the core sample enclosed within the first chamber.

To obtain a core sample with the coring apparatus of the present invention, it is lowered into the well bore on a drill string and with a core bit attached to the lower end thereof. Then, the drill string, outer barrel assembly and core bit is rotated to cut away an annular area at the bottom of the well bore, leaving a substantially cylindrical core extending upwardly into the inner barrel assembly. The core is broken near the base thereof and after assuring that it is totally within the first chamber, the valve assembly is actuated to sealingly enclose the core sample within the inner barrel assembly. Then the coring apparatus is raised to the surface of the well while at least some of the fluids contained in the core sample are allowed to expand into the second chamber, by displacing the piston or plug member therein. Thus, the sample pressure is reduced as the apparatus approaches the well surface, but without releasing any of the fluids or gases initially in the sample. The captured fluids and gases can be measured and analyzed when removed at the surface to obtain an accutrate analysis of the subterranean formation from which the sample came.

Thus, the coring apparatus and method of the present invention allows total and sealed capture of a high pressure core sample without producing a potentially hazardous situation at the surface when the sample is removed. Construction and operation of the apparatus for doing so is unique yet simple. Other objects and advantages of the invention will be apparent from the description which follows in conjunction with the accompanying drawings.

DESCRIPTION OF PREFERRED EMBODIMENTS

Figure 1A:
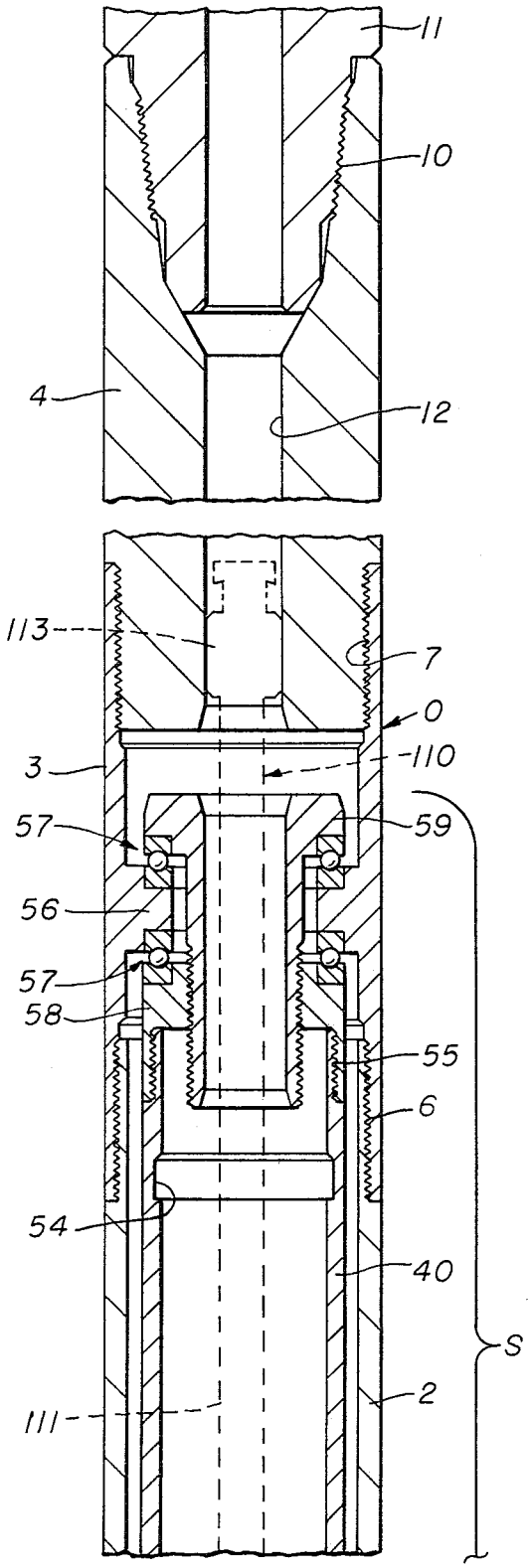
FIGS. 1A, 1B, 1C, and 1D are sectioned vertical views of coring apparatus according to a preferred embodiment of the invention as the apparatus would initially be disposed upon beginning to drill for a core sample, FIG. 1A illustrating an upper portion of the apparatus, FIGS. 1B and 1C continuing intermediate portions, and FIG. 1D a lower portion.

Referring now to FIGS. 1A, 1B, 1C and 1D, the coring apparatus of the present invention comprises an outer barrel assembly O and an inner barrel assembly I concentrically disposed therein. The inner barrel assembly I is connected to the outer barrel assembly O by a slip joint and bearing assembly S.

The outer barrel assembly O may be comprised of a plurality of tubular sections 1 and 2, bearing sub 3 and connection sub 4 connected by threaded joints 5, 6 and 7 or by any other suitable means. The lower end of the outer barrel assembly may be adapted for connection, by a threaded joint 8 or the like, to a conventional core bit 9. The upper end of the outer barrel assembhy O may be adapted with threads 10 or the like for connection to a drill string 11. It will be noted that the connection sub 4 is provided with a reduced diameter bore section 12 of a diameter no greater than the internal diameter of drill string 11.

The inner barrel assembly I may be comprised of a plurality of tubular sections 13, 14, 15, 16, 17 and 18 connected by threaded joints 19, 20, 21, 22, and 23. These tubular members substantially form the outer boundaries of first and second axially spaced chambers 24 and 25, respectively, disposed within the inner barrel assembly I and separated by an intermediate wall 26, which in the present embodiment for ease of assembly is a cylindrical plug which rests against an annular shoulder 27 and is sealed against chamber 25 by annular seals 28. It will be noted that the first chamber 24 and second chamber 25 are in constant fluid communication through flow passage 29 in the cylindrical section or valve sub 15.

The first chamber 24 is substantially fixed in volume. However, the second chamber 25 is expansible from a volume near nothing to a volume comparable with the volume of first chamber 24 by virtue of a cylindrical plug or piston member 30 coaxially disposed within tubular members 16 and 17 for limited axial movement therein. Sealing between the piston member 30 and the inner barrel assembly is provided by an annular seal assembly which includes a resilient member 31 and backup ring 32 retained between annular shoulder 34 and retainer ring 35. Piston 30 is, of course, limited in its downward movement by plug wall 26 and in its upper movement by an annular shoulder 36 provided in the cylindrical section 17. It will also be noted that the inner barrel assembly I is vented to the exterior thereof through vent ports 37 and 38 provided in cylindrical section 17.

Figure 1B:
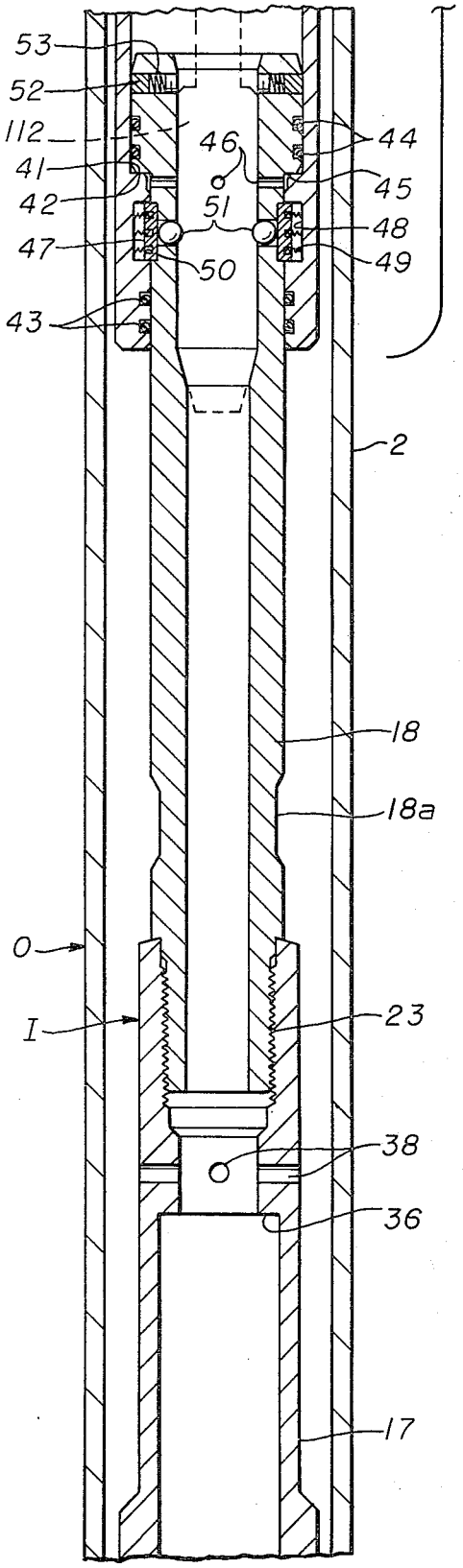
Figure 1C:
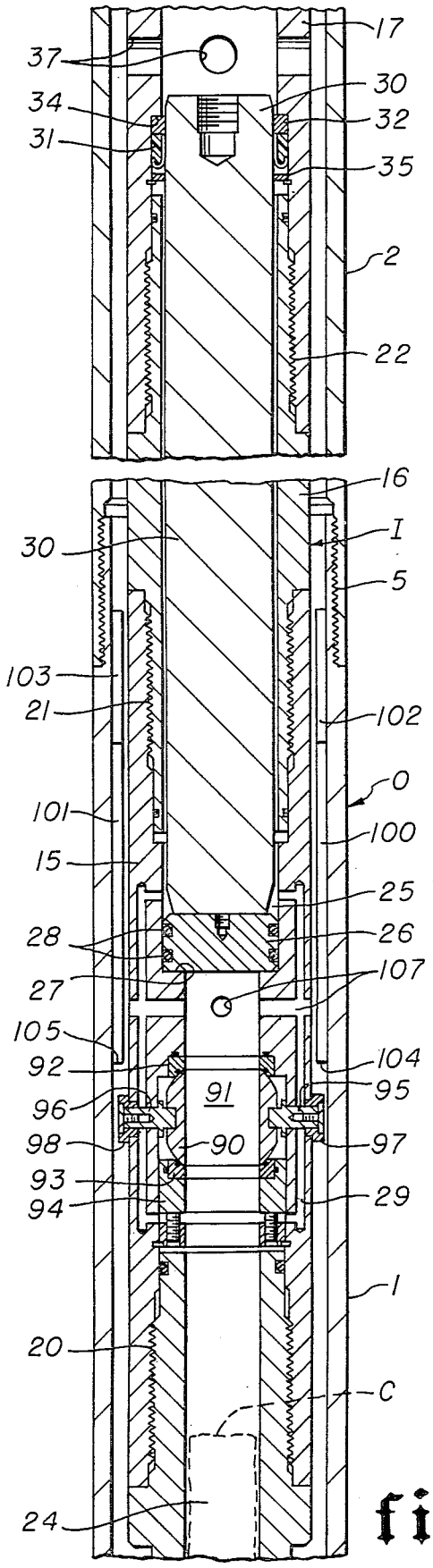

As previously mentioned, the inner barrel assembly I is connected to the outer barrel assembly O by a slip joint assembly S which includes a tubular joint 40 having an upwardly facing annular shoulder 41 against which a downwardly facing corresponding shoulder 42 of the inner barrel assembly I may rest or stop. First and second axially spaced annular seal members 43 and 44 are provided between inner barrel tubular section 18 and slip joint section 40, and by virtue of their different diameters create a differential pressure area within an expansible annular chamber which is in fluid communication with the interior of said inner barrel assembly through at least one port 46 in the walls thereof. Due to the slip joint connection, the inner barrel assembly I is axially movable within the outer barrel assembly O between an extended or first terminal position, as shown in FIGS. 1B, 1C and 1D and a contracted or second terminal position as shown in FIGS. 2A,2B, 2C and 2D.

Initially, the inner barrel assembly is maintained in the extended terminal position by a retainer assembly which includes a retainer key 47 carried in a recess 48 of slip joint section 40 and biased toward engagement with a corresponding keyway or key receptacle 50 on the exterior of tubular section 18. Engagement of the key 47 with the key receptacle 50 prevents both axial displacement of the inner barrel assembly I and rotation thereof with respect to the slip joint section 40. Also provided with the retainer assembly in suitably bored holes are ball members 51 which, as will be seen hereafter, act as a retainer release. For the time being, it is sufficient to note that balls 51 are engageable from the interior of the inner barrel assembly I and upon application of a radial force thereto, will cause the key retainer 47 to disengage the key receptacle 50 allowing the inner barrel assembly I to move upward, relative to slip joint section 40, toward its outer terminal position, the contracted or second position. As will be more fully described hereafter, the inner barrel assembly I and slip joint section 40 are also provided with a latch and latch receptacle for locking inner barrel assembly in the upper or contracted terminal position. The latch may comprise pins or lugs 52 mounted in suitable holes or recesses on the exterior of cylindrical section 18 and biased outwardly therefrom by spring members 53. The latch receptacle may comprise an annular recess 54 in the slip joint section 40 for engagement with the pin 52 when in proper axial registration therewith.

It will be noted that the slip joint section 40 is connected by a threaded joint 55 to a bearing assembly which includes an inwardly directed bearing flange 56 on the interior of bearing sub 3. Resting on opposite sides of bearing flange 56 is a pair of ball bearings 57 and 58. The ball bearings 57 and 58 are assembled and held in place by threadedly connected bearing collar and spool 58 and 59, respectively. The bearing assembly, of course, permits rotation of the slip joint section 40 relative to the outer barrel assembly. Likewise, the bearing assembly permits rotation of the inner barrel assembly I within the outer barrel assembly O. Rotation of the inner barrel assembly I and slip joint section 40 together are assured when the retainer assembly is engaged as shown in FIG. 1B.

Figure 1D:
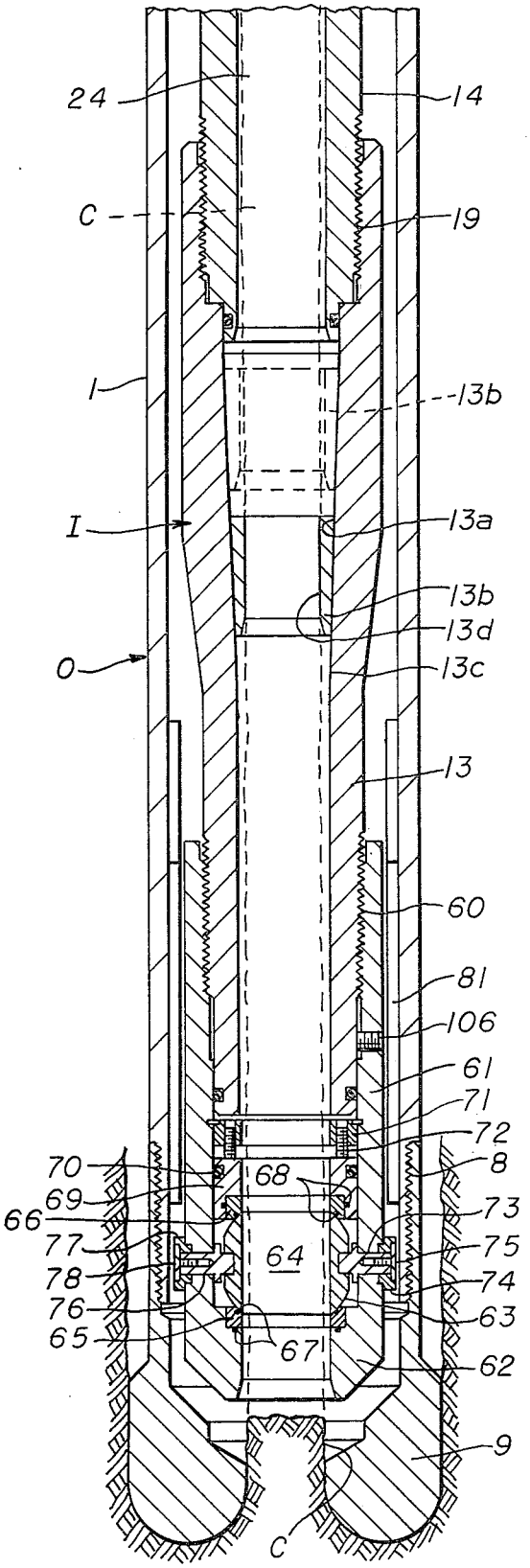
Figure 2A:
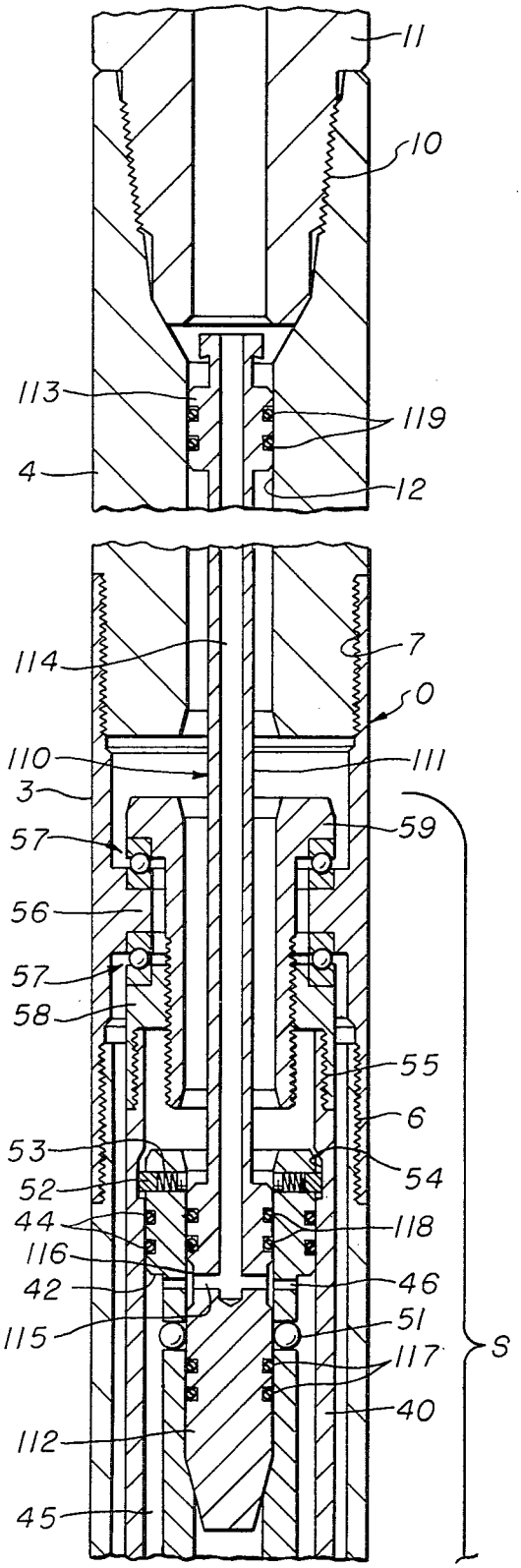
FIGS. 2A, 2B, 2C and 2D are sectioned vertical views of the coring apparatus shown in FIGS. 1A, 1B, 1C and 1D as the apparatus would be disposed following the capture of a core sample and sealing enclosure thereof within the apparatus just prior to removal of the surface of a well, FIG. 2A illustrating an upper portion, FIGS. 2B and 2C continuing intermediate portions, and FIG. 2D illustrating the lower portion.
Figure 2B:
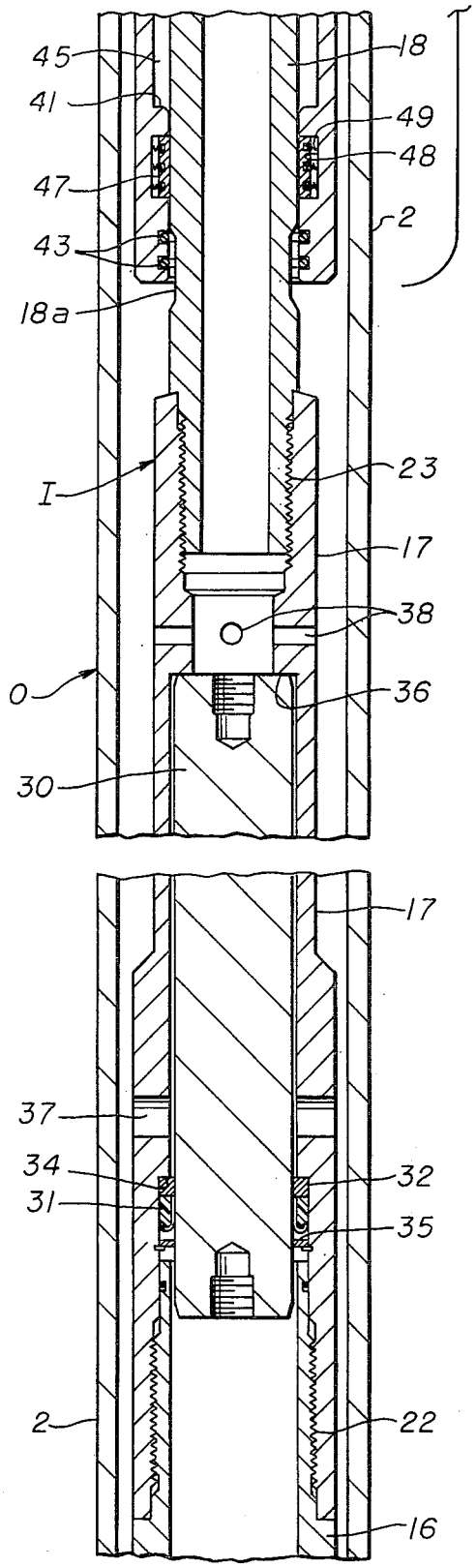
Figure 2C:
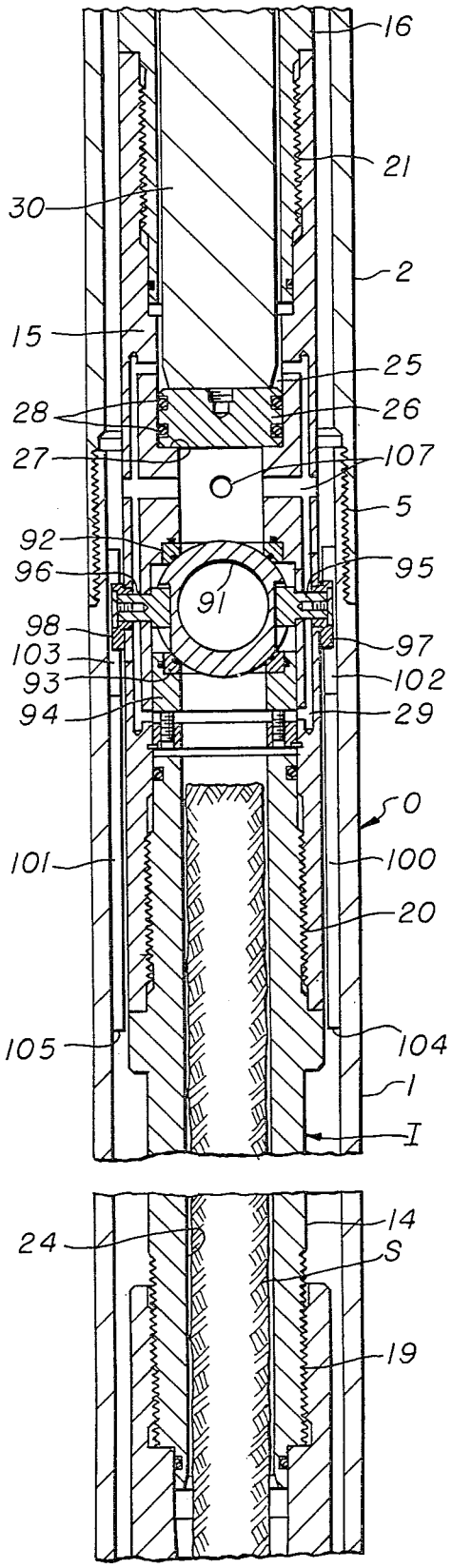
Figure 2D:
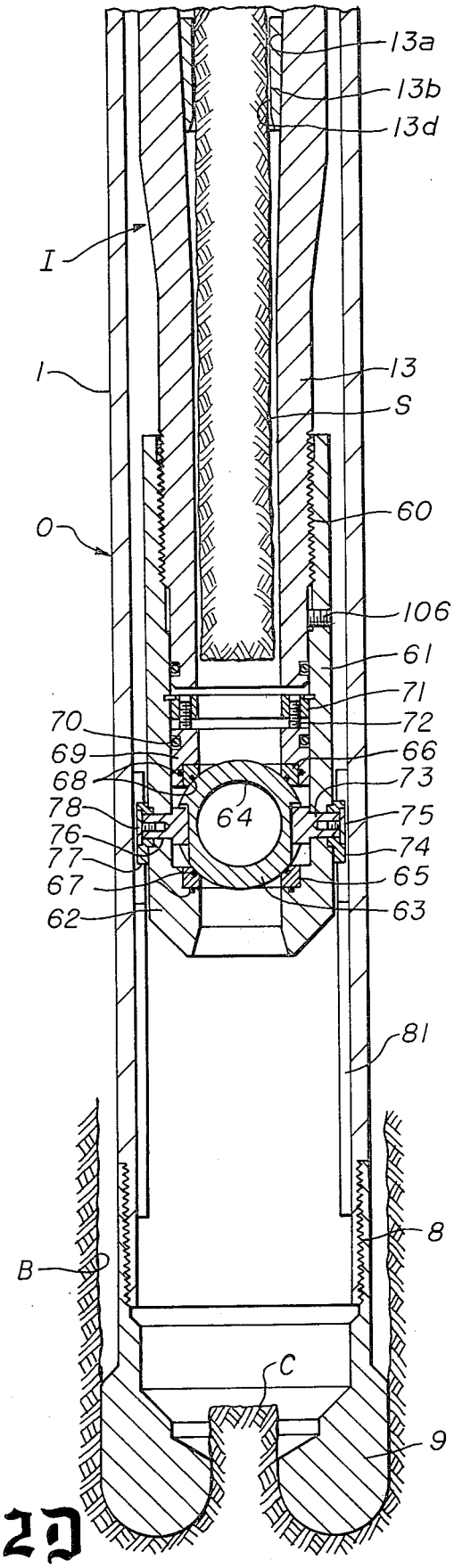
Figure 3:
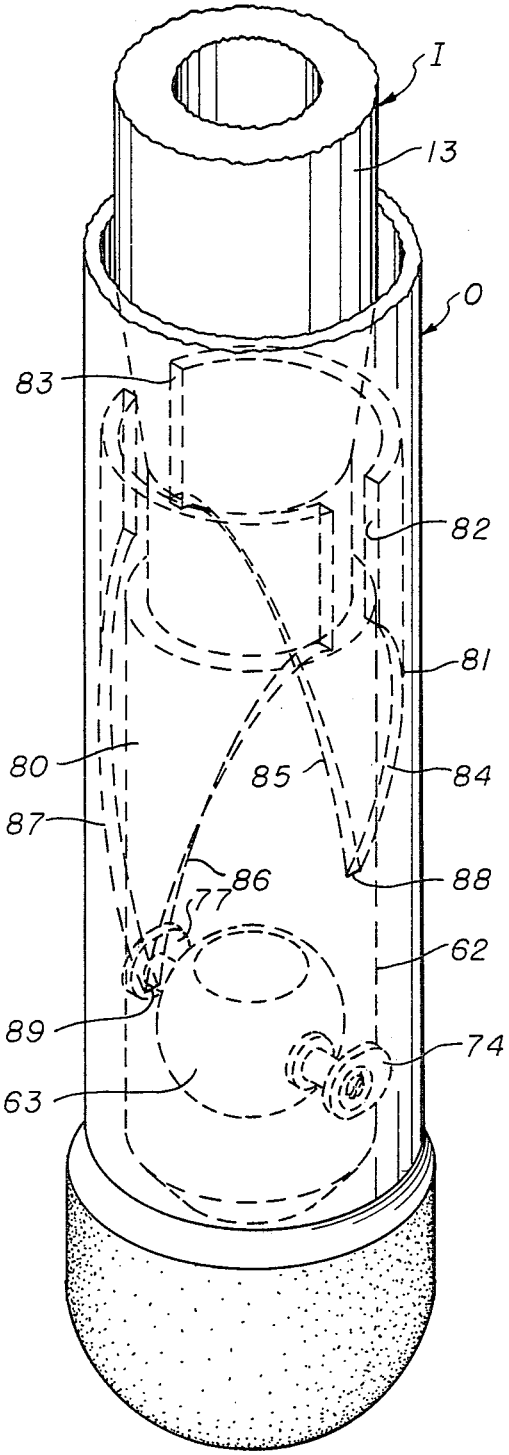
FIG. 3 is a perspective view of the lower portion of the coring apparatus of the present invention, interior portions of which are illustrated by hidden lines to show the disposition of a valve assembly in the open position of FIG. 1D.

Referring now particularly to FIG. 1D, it will be noted that attached to the lower end of the inner barrel assembly I by a threaded joint 60 is a first or lower valve assembly having a cylindrical housing 61, the bore of which is reduced at the lower end thereof to form an inwardly projecting flange nose 62. Mounted in the housing for rotation between an open position, as shown in FIG. 1D, and a closed position, as shown in FIG. 2D, is a ball-type closure member 63. The diameter of the opening or bore 64 through the closure member 63 is substantially the same as the minor diameter of inner barrel assembly chamber 24. Axially spaced on each side of the ball member 63 is a pair of annular seats 65 and 66 having suitable seal members 67 and 68. Seat member 65 is retained in a suitable annular recess of nose flange 62 while seat member 66 is maintained in a suitable recess of a seat retainer 69. An annular seal 70 is provided between the seat retainer 69 and the housing 61. To provide for the assembly of the valve and for adjusting the pressure of the seal members 65 and 66 against the closure member 63, an annular thrust collar 71 is provided with a plurality of screws 72 for bearing against the upper end of seat retainer 69. These screws 72 can be adjusted to increase or decrease, as required, the sealing forces against the closure member 63. Engaging the closure member 63 for operation thereof and mounted in a suitable bearing fashion through housing 61 are valve stems or trunions 73 and 76. Externally of the valve housing 61, the stem members 73 and 76 are attached to elongated cam-like members or levers 74 and 77 by screws 75 and 78, respectively. Referring also to FIG. 3, elongated levers 74 and 77 are initially in a substantially horizontal or transverse position relative to the axis of the inner and outer barrel assemblies.

Provided within the lower interior of cylindrical member 1 of the outer barrel assembly O is a pair of substantially semi-cylindrical sleeve sections 80 and 81 separated from each other enough to form channel-like slots 82 and 83 diametrically opposed from each other, of a width slightly greater than the width of the valve operating levers 74 and 77. The lower ends of each of the sleeve sections 80 and 81 are symmetrically tapered from the slots 82 and 83 to form surfaces 84, 85, 86 and 87 which converge at tips 88 and 89. The inner sleeve members 80 and 81 can be formed from a piece of cylindrical material and simply welded, shrunk-fit or attached in any other suitable fashion to the interior of cylindrical section 1. It will be noted that in the initially or extended terminal position of the inner barrel assembly I, the valve operating levers 74 and 77 lie below the points 88 and 89 (FIG. 3) at a sufficient distance to prevent the sleeve sections 80 and 81 from interfering with rotation of the inner barrel assembly I within the outer barrel assembly O when the inner barrel assembly I is in the extended terminal position.

Figure 4:
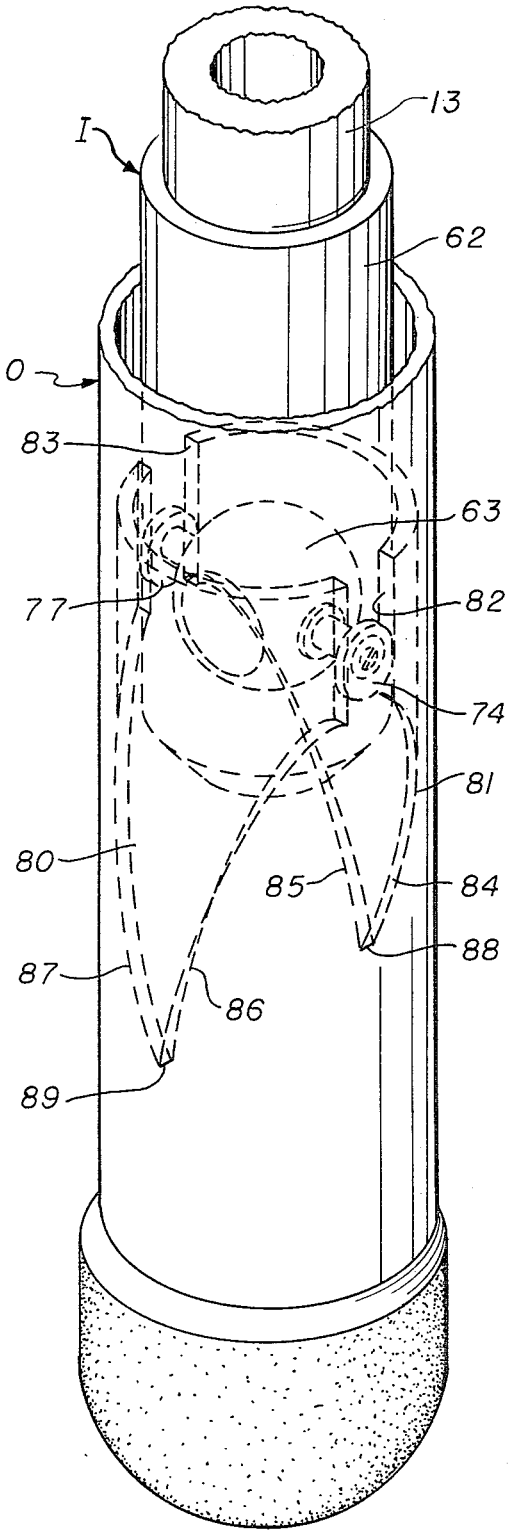
FIG. 4 is a perspective view of the lower portion of the coring apparatus of the present invention, interior portions of which are illustrated by hidden lines to illustrate movement of the valve assembly to the closed position of FIG. 2D.

The purpose of the sleeve sections 80 and 81 is to provide cam surfaces 84, 85, 86 and 87 for engagement by the valve operating levers 74 and 77, upon axial movement of the inner barrel assembly I to the contracted terminal position to rotate the closure member 63 to a closed position, such as shown in FIG. 4. Regardless of the initial radial position of the valve operating levers 74 and 77, they will be essentially centered between corresponding cam surfaces 84 and 86 and 85 and 87, respectively, if the inner barrel assembly I is displaced axially upward relative to the outer barrel assembly O until both ends of the elongated lever members 74 and 77 engage opposing cam surfaces 84 and 86, 85 and 87, respectively. Further upward axial displacement of the inner barrel assembly I would then cause the free end of the lever member 74 and 77 to pivot downwardly with respect to the valve stems or trunions until they are in a substantially vertical position, engaging the respective slots 82 and 83 as shown in FIG. 4. In this position, of course, the closure member 63 is in the closed position, sealing the opening or lower end of the inner barrel assembly chamber 24.

It will also be noted (FIGS. 1C and 2C) that another valve assembly, an upper or second valve assembly, is located near the upper end of chamber 24 and carried by valve sub 15. Like the previously described valve assembly, the second valve assembly includes a ball type closure member 90 having a cylindrical opening 91 therethrough. Annular valve seats 92 and 93 are provided in annular recesses of the valve sub 15 and seal retainer 94, respectively. Valve stems or trunions 95 and 96 extend through the valve sub 15 for engagement by operating levers 97 and 98, similar to the operating levers 74 and 77 of the first valve assembly. Likewise, the interior of cylindrical section 1 of the outer barrel assembly O is provided with semi-cylindrical sleeve sections forming cammed surfaces such as 100 and 101 converging toward slots 102 and 103 as in the lower valve assembly. Vertical or axial clearance is also provided between the valve operating levers 97 and 98 and the points 104 and 105 which represent the downward termination of tapered cam surfaces 100 and 101.

The upper or second valve assembly is designed to operate in a fashion similar to the lower or first valve assembly and in fact to operate simultaneously therewith. To assure simultaneous operation, radial set screws 106 may be provided around the lower valve assembly housing 61 which after threaded adjustment of the joint 60 to the proper length for assuring simultaneous operation of the two valve assemblies, can be tightened or set to prevent accidental displacement of one valve assembly relative to the other. When both valve assemblies are closed, as illustrated in FIGS. 2C and 2D, most of the chamber 24 is sealingly contained between the valve assemblies. However, a small portion of chamber 24 above the upper valve assembly is vented to the exterior of the inner barrel assembly I by radial ports 107. This allows for displacement of fluid during coring operations.

It will be noted (see FIG. 1D) that the upper interior of tubular section 13 within chamber 24 is tapered to provide a frusto-conical surface or slip bowl **13*a*. Initially disposed within the lower end of the slip bowl 13*a* is a slip assembly 13*b* which can be made in any conventional manner. The backs of the slips are provided with tapered surfaces 13*c* to correspond with the taper of slip bowl 13*a*. The faces 13*d* of the slips may be provided with some sort of friction engaging surface for engaging the core sample as will be more fully understood hereafter. The slip assembly 13*b* is upwardly movable and outwardly expandable to an upper position, such as the one illustrated in FIG. 2D. In the upper positions, the internal diameter of the slips is substantially the same as the minor internal diameter of chamber 24 and the opening 64 through valve closure member 63**.

STATEMENT OF OPERATION

Referring now to all of the drawings, the method of operating and using the apparatus of the present invention will be described. The method will be described for removing a core sample S from the bottom of a well bore B which has already been drilled to a depth where a core sample is desired.

The method is begun by lowering the coring apparatus on a drill string 11 and with a core bit 9 attached thereto. Various components of the coring apparatus are in the positions shown in FIGS. 1A, 1B, 1C and 1D. Upon reaching the bottom of the well bore B, the drill string and outer barrel assembly O are rotated, causing the core bit to cut away an annular area at the bottom of the well bore, leaving a substantially cylindrical core C extending upwardly therefrom. Drilling fluids come through the drill string 11, circulate through the interior of slip joint section 40, inner barrel assembly sections 18 and 17 through ports 38 and 37, then the annular space between the inner and outer barrel assemblies for exit through the bit 9 and return to the surface of the well on the exterior of the outer barrel assembly O and drill string. As drilling continues, the core extends upwardly through the opening 64 of the lower valve assembly closure member 63 into the chamber 24 and eventually to some position generally represented by the dotted lines shown in FIGS. 1C and 1D. As the core begins to extend into the chamber 24, it first contacts the bottom of the slips **13*b*, causing them to be pushed upwardly along the tapered slip bowl surface 13*a* and allowing them to radially expand to the dotted line position near the top of the bowl. At this point, the internal diameter of the slips 13*b* is substantially the same as the external diameter of the core C and the core is allowed to pass through the slips and continue extending upwardly into chamber 24**.

It will be noted that during the drilling operation when the drill string and outer barrel assembly O are rotating, the inner barrel assembly I will engage the stationary core C. Due to the friction between the inner barrel assembly I and the core C, there is a tendency for the inner barrel assembly I not to rotate. Furthermore, since the slip joint section 40 is mounted on the rotating bearing assembly and since the inner barrel assembly I is keyed to the slip joint section 40 by retainer key 47, the inner barrel assembly I will more than likely not rotate as drilling for the core C continues.

Upon approaching the desired amount of core, the core is broken off near its base, leaving a core sample S thereabove. Then, rotation of the drill string and core bit 9 is continued until the entire core sample S is contained within the chamber 24 above the closure member 63 of the lower valve assembly. Then, the entire drill string and coring apparatus is lifted to clear the core remaining in the well from the closure member 63. During the lifting operation, the core sample S will remain within the chamber 24 since it is being held there by the gripping action of slips **13*b***.

Next, an elongated plug or dart member 110 is dropped through the drill string 11 for sealing engagement with the inner barrel assembly I. The plug member 110 (best shown in FIG. 2A) may comprise a tubular body 111 having an enlarged nose portion 112 and an enlarged tail portion 113. A central passage 114 extends from the upper end of the plug member 110 through the body 111 terminating within the nose portion 112. At least one radial port 115 intersects the passage 114 allowing it to communicate with the exterior of the nose portion 112 in an annular recess 116. The nose portion is provided with annular seal assemblies 117 and 118, on opposite sides of the recess 116. The tail portion 113 is also provided with seal assemblies 119. Initially, the dart or plug member 110 sealingly engages the upper interior of inner barrel assembly section 18 and the bore 12 of outer barrel assembly sub 4 as indicated by the dotted lines in FIGS. 1A and 1B. As the nose member 112 proceeds past the key retainer assembly, it forces the ball members 51 and consequently keys 47 radially outward against the biasing springs 49 until the keys 47 disengage the keyways 50 releasing the retainer assembly and leaving the inner barrel assembly I free for axial movement in the slip joint section 40.

It will be noted that in this position, the central passage 114, port 115 and recess 116 of plug member 110 and port 46 through the walls of inner barrel assembly 18 provide fluid communication between the drill string 11 and the expansible chamber 45. By increasing the pressure in the drill string, this pressure is communicated with the expansible chamber 45, creating a force against the annular area 42 necessary to raise the inner barrel assembly I to the positions shown in FIGS. 2A, 2B, 2C and 2D. Upon reaching this second or contracted terminal position, latches 52 engage the annular latch recess 54 holding the inner barrel assembly I in the position of FIGS. 2A, 2B, 2C and 2D. It will be noted that section 18 is provided with an annular recess **18*a* which relieves the pressure within expansible chamber 45 when the seals 43** slide past it.

As the inner barrel assembly I is raised to the contracted terminal position, the valve operating levers 74, 77, 97, 98 of the lower and upper valve assemblies engage the cammed surfaces of the corresponding sleeve sections within the outer barrel assembly O causing the closure members 63 and 90 to rotate to the closed positions of FIGS. 2C and 2D in a manner previously described with reference to FIGS. 3 and 4. With the valve assemblies in these positions, the core sample S is totally and sealingly enclosed within chamber 24. Thus, the core sample S is captured under bottom-hole pressure conditions, which may be as high as 10,000 psi. It will be noted, however, that the chamber 24 is in fluid communication with expansible chamber 25 through passage 29.

Once the inner barrel assembly I is locked in its contracted terminal position with the core sample S totally enclosed between the valve assemblies, the drill string and attached coring apparatus is lifted toward the surface of the well. As the string is lifted, the fluid pressure communicated to the upper end of plug 30 from the drill string begins to reduce. Since the plug member 30 is merely a balanced piston, the fluids within the core sample S begin to expand through passage 29 into the expansible chamber 25, causing the pressure balancing plug 30 to rise as the apparatus gets closer to the surface of the well. If the initial pressure under which the core sample S was captured is great enough, the pressure balancing plug 30 will continue to rise until it is stopped against the annular shoulder 36. The expansion of the fluids in the chamber 24, of course, reduces the pressure therein and upon reaching the surface of the well, the apparatus is under reduced and manageable pressures, yet retaining all of the liquids and gases existing at the bottom of the well bore. Therefore, a complete and accurate analysis of the strata being sampled can be obtained. In addition, by measuring the movement of the plug 30, the bottom hole pressure can be estimated.

Thus, it can be seen that with the coring apparatus of the present invention, a core sample may be taken from the bottom of a well hole, totally captured and sealed in an inner barrel assembly and removed to the surface of the well. This unique apparatus provides a pressure balancing feature which gradually allows the sample pressure to decrease as it approaches the well surface but without releasing any of the fluids or gases initially captured. Thus, many of the disadvantages of the prior art are overcome.

While the apparatus and method of utilization thereof are relatively simple, they uniquely fill a long-wanted need in the coring art. Although only one preferred embodiment of the invention has been described herein, many variations thereof may be made by those skilled in the art. Accordingly, it is intended that the scope of the invention be limited only by the claims which follow.

I claim:

1. Coring apparatus for obtaining core samples from the bottom of a well bore comprising:

an outer barrel assembly the lower end of which is adapted for connection to a core bit, the upper end of which is adapted for connection to a drill string;

an inner barrel assembly concentrically disposed within said outer barrel assembly for limited axial movement therein and having first and second axially spaced and fluid communicating chambers therein;

slip joint means connecting said inner and outer barrel assemblies and having a tubular joint member, first and second axially spaced annular seal means between said slip joint means and a portion of said inner barrel assembly, the interior of said tubular joint member and the exterior of said portion of said inner barrel assembly forming an expansible annular chamber in fluid communication with the interior of said inner barrel assembly through at least one port in the walls thereof;

valve means carried by said inner barrel assembly movable, in response to said axial movement of said inner barrel assembly, from an open position, in which said core sample may be received by said first chamber, to a closed position, sealingly enclosing said core sample within said first chamber; and pressure compensating means sealingly disposed within said second chamber allowing expansion of said second chamber for receiving expanding fluids from said core sample enclosed within said first chamber.

2. Coring apparatus as set forth in claim 1 in which said second chamber is cylindrical and said pressure compensating means comprises a cylindrical plug member coaxially disposed within said second chamber for limited axial movement therein, one end of said plug member and said second chamber being in fluid communication with said first chamber at all times, the other end of said plug member being exposed to the pressure environment within said outer barrel assembly.

3. Coring apparatus as set forth in claim 2 including annular seal means disposed between the walls of said second chamber and said plug member sealing therebetween throughout said limited axial movement of said plug member.

4. Coring apparatus as set forth in claim 1 in which the external diameter of said inner barrel assembly is greater at said first seal means than at said second seal means forming an annular area therebetween which when subjected to predetermined pressure differential between said expansible annular chamber and the exterior of said inner barrel assembly effects said limited axial movement of said inner barrel assembly from an extended terminal position to a contracted terminal position.

5. Coring apparatus as set forth in claim 4 including an elongated plug member which, when said apparatus is connected to a drill string, is movable through said drill string for sealing engagement with the interior of said inner barrel assembly and having a port therein for registration with said port in the walls of said inner barrel assembly through which the pressure in said drill string may be communicated to said expansible annular chamber for effecting said limited axial movement of said inner barrel assembly.

6. Coring apparatus as set forth in claim 4 in which said tubular joint member and said portion of said inner barrel assembly are provided with latch and latch receptacle means mutually engageable upon said movement of said inner barrel assembly to said contracted terminal position to lock said inner barrel in said contracted terminal position.

7. Coring apparatus as set forth in claim 1 in which said tubular joint member and said portion of said inner barrel assembly are provided with retainer and retainer receptacle means mutually engageable when said inner barrel assembly is in said extended terminal position to lock said inner barrel in said extended terminal position.

8. Coring apparatus as set forth in claim 7 in which said retainer and retainer receptacle means, when said inner barrel assembly is in said extended terminal position, also locks said inner barrel assembly against rotation relative to said tubular joint member and in which said tubular joint member is attached to bearing means carried by said outer barrel assembly permitting rotation of said inner barrel assembly relative to said outer barrel assembly.

9. Coring apparatus as set forth in claim 7 including an elongated plug member which, when said apparatus is connected to a drill string, is movable through said drill string for engagement with retainer release means carried by said inner barrel assembly to release said retainer and retainer receptacle means unlocking said inner barrel assembly for said axial movement toward said contracted terminal position.

10. Coring apparatus as set forth in claim 1 in which said valve means comprises at least one valve assembly at the lower end of said first chamber having a closure member, and stem member, said stem member being attached to a cam member engageable with a cam surface on the interior of said outer barrel assembly, upon said limited axial movement of said inner barrel assembly therein, for rotation of said stem means to move said closure member between said open and closed positions.

11. Coring apparatus as set forth in claim 10 in which said closure member is of the ball type which in the open position has a cylindrical opening therethrough of substantially the same diameter as the diameter of said first chamber.

12. Coring apparatus as set forth in claim 10 in which said inner barrel assembly is rotatable within said outer barrel assembly in at least one terminal of said limited axial movement therein.

13. Coring apparatus as set forth in claim 1 in which said valve means comprises a first valve assembly at the lower end of said first chamber, a second valve assembly at the upper end of said first chamber, and means for simultaneously moving said first and second valve assemblies from said open to said closed positions, sealingly enclosing said core sample therebetween.

14. Coring apparatus as set forth in claim 13 in which said fluid communication between said first and second chambers is established through a fluid passage terminating at one end in said first chamber between said first and second valve assemblies and at the other end in the expansible area of said second chamber.

15. Coring apparatus as set forth in claim 14 in which a portion of said first chamber above said second valve assembly is vented to the exterior of said inner barrel assembly.

16. Coring apparatus as set forth in claim 1 in which a portion of said first chamber has a frusto-conical surface on which is carried slip means engageable with a core sample being received by said first chamber to prevent said core sample from being lost therefrom on upward axial movement of said inner barrel assembly.

17. Coring apparatus as set forth in claim 16 in which said outer barrel assembly is rotatable relative to said inner barrel assembly when said valve means are in said open position.

18. A method of obtaining a core sample from a well bore comprising the steps of:

lowering a core barrel into said well bore on a drill string; said core barrel comprising an outer barrel assembly, the upper end of which is attached to said drill string and the lower end of which is attached to a core bit; an inner barrel assembly disposed within said outer barrel assembly for limited axial movement and selective rotational movement relative thereto and having first and second axially spaced and fluid communicating chambers therein; and valve means carried by said inner barrel assembly for opening and closing said first chamber;

rotating said drill string, outer barrel assembly and said core bit to cut away an annular area at the bottom of said well bore, leaving a substantially cylindrical core extending upwardly into said inner barrel assembly;

breaking said core near the base thereof to provide a core sample of desired length;

continuing to rotate said drill string until said broken core sample is totally within said first chamber;

lifting said drill string to clear core remaining in said well bore;

dropping an elongated plug member through said drill string for sealing engagement with the interior of said inner barrel assembly, said elongated plug member having a port therein for registration with a port in the walls of said inner barrel assembly through which fluid pressure in said drill string may be communicated to an expansible chamber formed between said inner barrel assembly and a tubular joint member connecting said inner barrel assembly to said outer barrel assembly;

raising said inner barrel assembly within said outer barrel assembly from an extended terminal position to a contracted terminal position by applying fluid pressure through said drill string to said expansible annular chamber thereby actuating said valve means to sealingly enclose said core sample within said inner barrel assembly; and raising said core barrel to the surface of said well while allowing at least some of the fluids contained in said core sample to expand into said second chamber.

19. The method of claim 18 in which fluid communication is provided between said first and second chambers at all times.

20. The method of claim 18 in which said inner barrel assembly is allowed rotational movement independently of said outer barrel assembly during said rotating of said drill string and outer barrel assembly to cut away said annular area.

21. The method of claim 18 in which said inner barrel assembly is locked in said contracted terminal position before said raising to the surface of said well.

22. The method of claim 18 in which said valve means comprises a first valve assembly at the lower end of said first chamber and a second valve assembly at the upper end of said first chamber, said first and second valve assemblies being simultaneously closable to sealingly enclose said core sample within said first chamber upon said actuating of said valve means.

23. The method of claim 22 in which a portion of said first chamber above said second valve assembly is vented to the exterior of said inner barrel assembly at all times.

24. The method of claim 18 in which said second chamber is provided with a cylindrical plug sealingly engaging the walls thereof, one end of which is exposed to the pressure environment surrounding said inner barrel assembly, the other end of which is in fluid communication with said first chamber through a flow passage in said inner barrel assembly, said second chamber being expansible to allow said expanding core sample fluids to expand into said second chamber by axial movement of said cylindrical plug therein.

25. The method of claim 24 in which said first and second chambers are maintained in fluid communication through said flow passage at all times.

* * * * *